US005961201A

United States Patent [19]

Gismondi

[11] Patent Number: 5,961,201

[45] Date of Patent: Oct. 5, 1999

[54] POLYCHROME LIGHTING DEVICE HAVING PRIMARY COLORS AND WHITE-LIGHT SOURCES WITH MICROPROCESSOR ADJUSTMENT MEANS AND REMOTE CONTROL

[75] Inventor: Ernesto Gismondi, Milan, Italy

[73] Assignee: Artemide S.p.A., Milan, Italy

[21] Appl. No.: 08/783,166

[22] Filed: Jan. 14, 1997

[30] Foreign Application Priority Data

Feb. 14, 1996 [IT] Italy ..... MI96A0284

[51] Int. Cl.[6] ..... F21M 9/00; F21S 9/00

[52] U.S. Cl. ..... 362/233; 362/230; 362/231; 362/293; 362/295; 362/2; 362/1

[58] Field of Search ..... 362/230, 231, 362/293, 295, 2, 1

[56] References Cited

U.S. PATENT DOCUMENTS

| | | | |
|---|---|---|---|
| 3,564,332 | 2/1971 | Blakeslee | 315/154 |
| 4,598,345 | 7/1986 | Kleeman | 362/233 |
| 5,192,126 | 3/1993 | Remeyer et al. | 362/184 |
| 5,209,560 | 5/1993 | Taylor et al. | 362/85 |
| 5,329,431 | 7/1994 | Taylor et al. | 362/85 |
| 5,406,176 | 4/1995 | Sugden | 315/292 |
| 5,506,715 | 4/1996 | Zhu | 359/147 |
| 5,597,231 | 1/1997 | Rosset | 362/231 |

FOREIGN PATENT DOCUMENTS

| | | |
|---|---|---|
| 786 289 | 1/1973 | Belgium . |
| 06 84 421 | 11/1995 | European Pat. Off. . |
| 39 17 101 | 11/1990 | Germany . |
| 22 88 903 | 11/1995 | United Kingdom . |

*Primary Examiner*—Sandra O'Shea
*Assistant Examiner*—Ronald E. DelGizzi
*Attorney, Agent, or Firm*—Guido Modiano; Albert Josif

[57] ABSTRACT

A polychrome lighting device, including at least one light source for each one of the three primary colors and elements for adjusting the light sources, the adjustment elements being adapted to independently control the adjustment of the luminous intensity of the light sources in order to combine the light beams emitted by the sources into a light beam having the desired shade of color, remote control elements being also provided for setting, storing, and retrieving desired luminous intensity values of the light sources and therefore desired light colors.

12 Claims, 2 Drawing Sheets

POLYCHROME LIGHTING DEVICE HAVING PRIMARY COLORS AND WHITE-LIGHT SOURCES WITH MICROPROCESSOR ADJUSTMENT MEANS AND REMOTE CONTROL

BACKGROUND OF THE INVENTION

The present invention relates to a polychrome lighting device, particularly adapted for use in household and work spaces, in the theatrical, catering, and showbusiness fields, and the like.

Conventional lighting means used to light indoor spaces of buildings and the like are currently predominantly constituted by so-called white-light lamps, which emit a light which is often "cold" and therefore not particularly pleasant both from the visual point of view and from the emotional point of view for people living in such enclosed spaces.

Studies have proved a close correlation between the mood of an individual, his working efficiency, and the type of light that illuminates the space in which he lives.

In other fields, for example in the theatrical field, where it is indispensable to provide particular stage effects, it is commonly known to use a light source in front of which colored filters are placed in order to provide desired color combinations.

A drawback of this solution is the need to move the various filters manually in front of each other, with the problem of the noise linked to this movement and of the complexity of the device which is required.

For example, in the case of theaters, where absolute silence is required, such a solution has considerable drawbacks in application.

The transfer of this solution to other enclosed spaces appears to be even more troublesome due to the difficulty in finding adapted spaces and to cost and complexity issues.

SUMMARY OF THE INVENTION

A principal aim of the present invention is therefore to provide a polychrome lighting device which allows to achieve lighting of the desired color.

Within the scope of this aim, an object of the present invention is to provide a polychrome lighting device which provides a light of the desired color in an automated fashion.

Another object of the present invention is to provide a polychrome lighting device which can be used in any enclosed space.

Another object of the present invention is to provide a polychrome lighting device which does not entail the manual movement of filters.

A further object of the present invention is to provide a device which is highly reliable and relatively easy to manufacture at competitive costs.

This aim, these objects, and others which will become apparent hereinafter are achieved by a polychrome lighting device, characterized in that it comprises at least one light source for each one of the three primary colors and means for adjusting said light sources, said adjustment means being adapted to independently control the adjustment of the luminous intensity and/or light flux of said light sources to combine the light beams emitted by said sources into a light beam having the desired shade.

BRIEF DESCRIPTION OF THE DRAWINGS

Further characteristics and advantages of the invention will become apparent from the following detailed description of a preferred but not exclusive embodiment of the device according to the invention, illustrated only by way of non-limitative example in the accompanying drawings, wherein.

DESCRIPTION OF THE PREFERRED EMBODIMENTS

Figure 1:
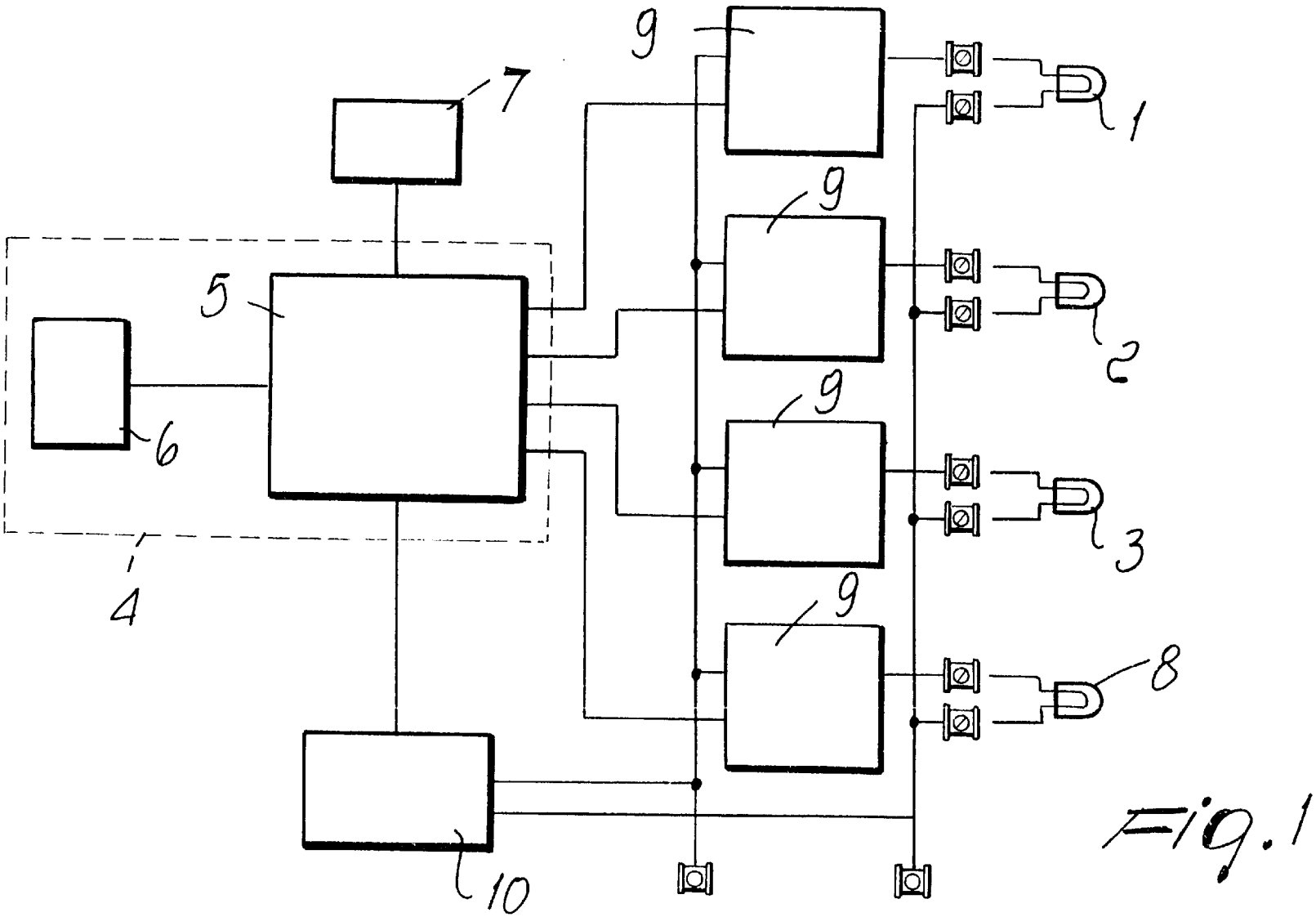
FIG. 1 is a block diagram of the device according to the invention.

With reference to FIG. 1, the device according to the invention comprises three light sources which are appropriately filtered in the three primary colors: red, green, and blue. The three light sources are designated by the reference numerals 1, 2, and 3 respectively. The filters, of a known type, are not referenced in the figure.

There is also provided a fourth white-light source 8.

The four light sources 1, 2, 3, and 8 are appropriately constituted, for example, by filament lamps, each provided with a filter, or by discharge lamps (for example fluorescent lamps) which respectively emit light of (in) said colors.

The colors of the filters used are therefore red, green, blue, and white.

The mixing of the three primary colors (red, green, and blue) allows to obtain any desired color.

Adjustment means 4 are provided to switch on and off and adjust the lamps 1, 2, 3, and 8.

The adjustment means 4 can be of the electromagnetic or electronic type. In the electronic version, they comprise processing means, advantageously constituted by a microprocessor 5, and signal detection means, constituted for example by an infrared sensor 6.

The microprocessor 5 is connected to non-volatile memory means 7, which are adapted to store values of the luminous intensities and/or of the light flux of each one of the light sources 1, 2, 3, and 8.

Each lamp 1, 2, 3, and 8 is controlled independently so as to switch on, switch off, and be adjusted by the microprocessor 5 by means of adjustment circuits with power control 9, which are adapted to adjust the luminous intensity gradually from a zero value to the maximum value.

Advantageously, said adjustment circuits 9 comprise, for example, a triac. There is provided a triac 9 for each lamp.

Power supply means 10 supply said microprocessor 5 and said triacs 9.

Figure 2:
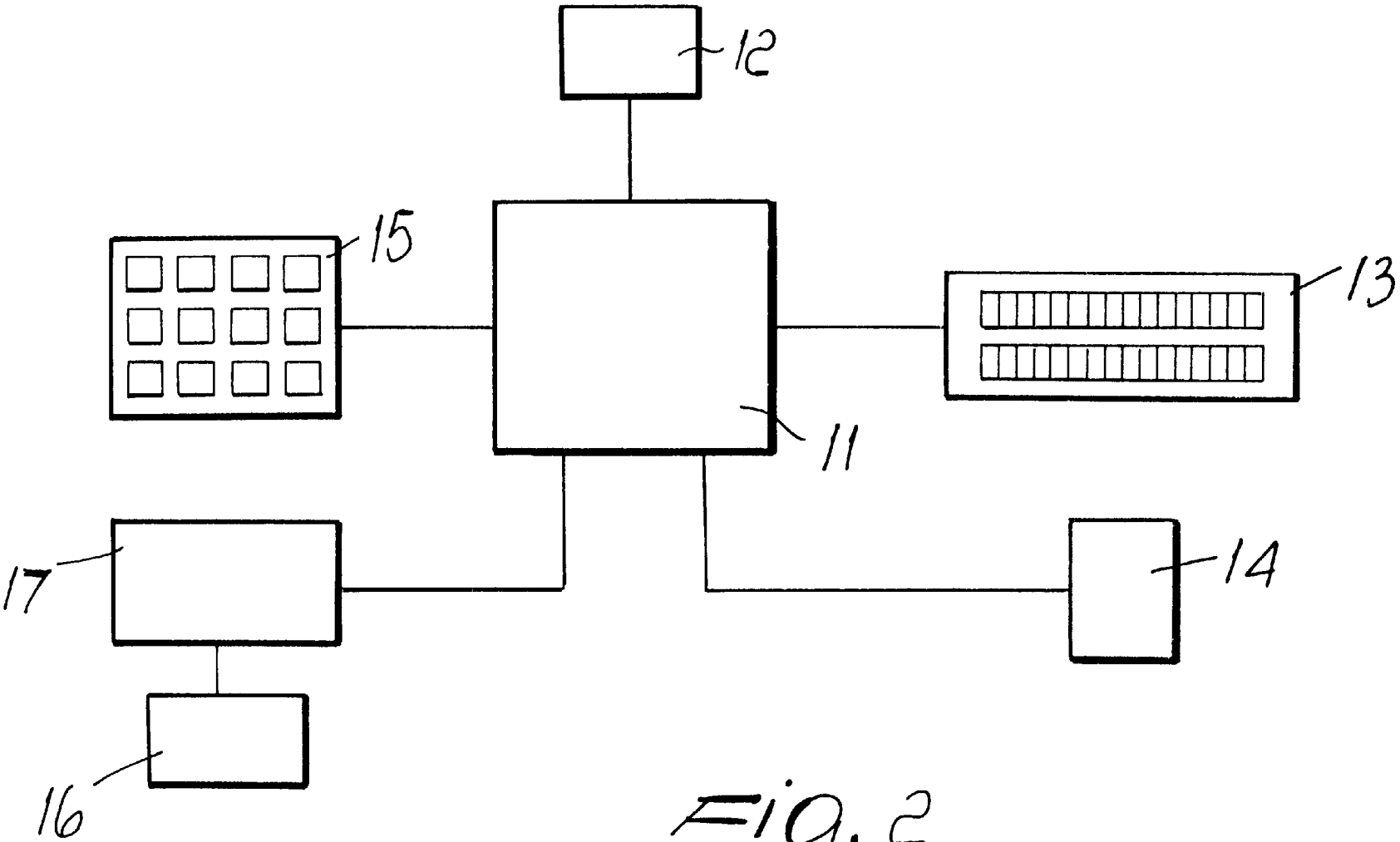
FIG. 2 is an exemplifying block diagram of a remote control according to the invention for controlling the device illustrated in FIG. 1.

Remote control means, shown as a block diagram in FIG. 2, control the device of FIG. 1.

In detail, the remote control means comprise a microprocessor 11 which is connected to nonvolatile memory means 12, to display means 13, to signal transmission means 14, and to data entry means 15.

Advantageously, for example, the display means comprise an alphanumeric liquid-crystal display, the signal transmission means 14 comprise an infrared transmitter, and finally the data entry means comprise for example a keyboard.

Power supply means, advantageously constituted by a battery 16, are connected to power supply control means 17 and to the microprocessor 11.

The power supply control means 17 have the purpose of protecting the charge of the battery by switching on the remote control means at the first pressing of a key of the keyboard 15 and switching them off after a preset idle time.

The three lamps for the three primary colors 1, 2, and 3, plus optionally the fourth lamp 8 for white light, are orientated in a fixed arrangement in the same direction, so that their light beams merge into a single beam.

With reference to the above figures, operation of the device according to the invention is as follows.

The user, through the remote control means, sets for each lamp 1, 2, 3, and 8 (if provided) a luminous intensity or light flux value at will, so that the lamps emit beams of light, filtered by the filters of the three primary colors, which merge into a single beam, the shade whereof is obviously a function of the value of the luminous intensity value assigned to each lamp.

In this manner it is possible to obtain light effects with variable and soft colorings and the user can select a color combination of his liking.

The adjustment means 4 and the triacs 9 allow a gradual adjustment of the luminous intensity of the lamps or of the light flux from a minimum value to a maximum value.

If the luminous intensities of the lamps of the three primary colors 1, 2, and 3 are set to the same value, white light is obtained; otherwise, all the possible color shades of the spectrum are obtained.

The most strongly defined color, given by the combination of the three color beams of the lamps 1, 2, and 3, will occur at the center of the beam produced by the combination/mixing of the three individual beams, whilst softer tints will be provided at the edges of the resulting beam.

The white-light lamp 8 has the purpose of emitting a light of ordinary color when the user does not wish to use the color possibilities offered by the device according to the invention and seeks a light which is different from the light offered by the three lamps 1, 2, and 3, adjusted in a similar manner.

The remote control means allow to adjust from a distance the luminous intensity values of each one of the lamps 1, 2, 3, and 8 and to store the set combination, if one wishes to, in the nonvolatile memory means 12.

As a consequence of the pressing of keys on the keyboard 15 of the remote control means, the microprocessor 11 stores in the memory means 12 the command received from the keyboard 15, actuates the display means 13, actuates the adjustment means 15 by means of the infrared transmitter 14 in order to drive the lamps 1, 2, 3, and 8, and finally controls the power supply control means 17.

The set combination of the luminous intensities, if stored by the user, can therefore be retrieved at a later time.

The nonvolatile memory means 12 can have predefined luminous intensity combinations pre-stored in them which can be retrieved directly from the keyboard and are complemented by those programmed by the user.

A code is assigned to the preset combinations and is displayed on the liquid-crystal display 13 when said combinations are used.

As shown above, the lamp 8 is not indispensable for the operation of the device according to the invention but is an additional possibility offered to the user if he wishes to have a conventional white light.

The three or four lamps or light sources (according to the situation) therefore constitute a single lamp which is capable of emitting a light beam having infinite color combinations.

The device according to the invention also has a switch (not shown) for the emergency control of the lamp if the remote control means break down or if their battery 16 is drained.

In practice it has been observed that the device according to the invention fully achieves the intended aim, since it allows to mix, in a single beam, the light beams of the three primary colors, with the possibility of varying, independently for each beam, the luminous intensity in order to produce light effects having infinite possible shades.

operation of the device is controlled by remote control means which allow to adjust, store, and retrieve desired luminous intensity combinations without having to directly access the device.

Mixing of the three red, green, and blue monochrome beams which originate from three separate sources allows to overcome the drawback of conventional devices, in which it is necessary to manually move filters arranged on a single source, consequently generating noise.

The device thus conceived is susceptible of numerous modifications and variations, all of which are within the scope of the inventive concept.

Thus, for example, the lamps 1, 2, 3, and 8 can be orientated independently of each other in order to produce more differentiated light effects.

The three colors of the three incandescent lamps are not necessarily limited to the three primary colors but may also be different colors. In this case, of course, the resulting color combinations will also be different.

Moreover, the remote control means can be radio control means.

Finally, all the details may be replaced with other technically equivalent elements.

In practice, the materials employed, so long as they are compatible with the specific use, as well as the dimensions, may be any according to the requirements and the state of the art.

What is claimed is:

1. A polychrome lighting device, comprising:

at least one light source for each one of three primary colors;

a white-light source;

adjustment means for adjusting said light sources, said adjustment means independently controlling adjustment of luminous intensity and light flux of said light sources to combine light beams emitted by said sources into a light beam having a desired shade of color;

remote control means for controlling said adjustment means, said remote control means setting, storing, and retrieving desired values of the luminous intensity of each one of said light sources, said remote control means comprising data storing means for storing a plurality of combinations of luminous intensity settings of said light sources in order to allow reproducing of preset and user-set lighting conditions; and said adjustment means comprising a microprocessor and signal detection means, said signal detection means detecting signals sent by said remote-control means.

2. The device according to claim 1, comprising three light sources, each source having a filter for obtaining the three primary colors.

3. The device according to claim 1, wherein said signal detection means comprises an infrared sensor.

4. The device according to claim 1, comprising lighting circuits with power control for driving each one of said light sources, through said adjustment means.

5. The device according to claim 4, wherein said lighting circuits with power control comprise triacs.

6. The device according to claim 3, wherein said adjustment means comprises nonvolatile memory means, said memory means being connected to said microprocessor, said remote control means comprising a further microprocessor.

7. The device according to claim 1, comprising power supply means for powering said microprocessor.

8. The device according to claim 1, wherein said remote control means comprises means for displaying set functions.

9. The device according to claim 1, wherein said remote control means comprise a microprocessor, said means for storing data, and means for entering data for setting luminous intensity values which are independent for each one of said light sources and for retrieving luminous intensity value combinations which are preset or set by a user.

10. The device according to claim 1, wherein said light sources are orientated in a fixed fashion in the same direction.

11. The device according to claim 1, wherein said light sources are orientatable in different directions.

12. The device according to claim 1, wherein said remote control means are radio control means.

* * * * *